US009080129B2

(12) United States Patent
Benlahmar et al.

(10) Patent No.: US 9,080,129 B2
(45) Date of Patent: Jul. 14, 2015

(54) HYDROPHOBICALLY MODIFIED CATIONIC POLYMER

(71) Applicant: BASF SE, Ludwigshafen (DE)

(72) Inventors: Ouidad Benlahmar, Mannheim (DE); Aaron Flores-Figueroa, Mannheim (DE); Volodymyr Boyko, Mannheim (DE); Dieter Boeckh, Limburgerhof (DE); Markus Brym, Limburgerhof (DE); Christofer Arisandy, Ilvesheim (DE); Wolfgang Schrof, Neuleiningen (DE); Frank Huelskoetter, Bad Dürkheim (DE); Yonas Gizaw, West Chester, OH (US); Roy Jerome Harrington, Hamilton, OH (US); Sumanth Narahari Jamadagni, West Chester, OH (US); Peter Koenig, Montgomery, OH (US)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/945,502

(22) Filed: Jul. 18, 2013

(65) Prior Publication Data

US 2014/0024780 A1 Jan. 23, 2014

Related U.S. Application Data

(60) Provisional application No. 61/673,294, filed on Jul. 19, 2012.

(51) Int. Cl.

| | |
|---|---|
| ***D06M 15/263*** | (2006.01) |
| ***C11D 3/00*** | (2006.01) |
| ***C11D 3/37*** | (2006.01) |
| ***D06M 15/273*** | (2006.01) |
| ***D06M 15/285*** | (2006.01) |
| ***D06M 15/356*** | (2006.01) |

(52) U.S. Cl.

CPC ..... *C11D 3/001* (2013.01); *C11D 3/0015* (2013.01); *C11D 3/373* (2013.01); *D06M 15/263* (2013.01); *D06M 15/273* (2013.01); *D06M 15/285* (2013.01); *D06M 15/3562* (2013.01)

(58) Field of Classification Search

None

See application file for complete search history.

(56) References Cited

U.S. PATENT DOCUMENTS

| | | | | |
|---|---|---|---|---|
| 3,299,112 | A | 1/1967 | Bailey | |
| 4,818,421 | A | 4/1989 | Boris et al. | |
| 5,574,179 | A | 11/1996 | Wahl et al. | |
| 5,807,956 | A | 9/1998 | Czech | |
| 5,981,681 | A | 11/1999 | Czech | |
| 6,207,782 | B1 | 3/2001 | Czech et al. | |
| 6,482,969 | B1 | 11/2002 | Helmrick et al. | |
| 6,607,717 | B1 | 8/2003 | Johnson et al. | |
| 7,041,767 | B2 | 5/2006 | Lange et al. | |
| 7,217,777 | B2 | 5/2007 | Lange et al. | |
| 7,465,439 | B2 | 12/2008 | Avery et al. | |
| 7,732,050 | B2 * | 6/2010 | Nambu et al. | 428/407 |
| 2005/0048549 | A1 | 3/2005 | Cao et al. | |
| 2005/0098759 | A1 | 5/2005 | Frankenbach et al. | |
| 2006/0039939 | A1 | 2/2006 | Lai et al. | |
| 2006/0083705 | A1 | 4/2006 | Jachowicz et al. | |
| 2007/0041929 | A1 | 2/2007 | Torgerson et al. | |
| 2007/0163054 | A1 | 7/2007 | Wang et al. | |
| 2007/0286837 | A1 | 12/2007 | Torgerson et al. | |

FOREIGN PATENT DOCUMENTS

| | | | |
|---|---|---|---|
| WO | WO-01/05874 | A1 | 1/2001 |
| WO | WO-03021037 | A1 | 3/2003 |
| WO | WO-2006061334 | A1 | 6/2006 |

OTHER PUBLICATIONS

International Search Report for PCT/EP2013/064359, mailing date Oct. 4, 2013.

European Search Report, Application No. EP 12 17 7152, Dec. 14, 2012.

* cited by examiner

*Primary Examiner* — Marc Zimmer

(74) *Attorney, Agent, or Firm* — Drinker Biddle & Reath LLP

(57) ABSTRACT

The present invention relates to hydrophobically modified cationic polymers obtainable by the polymerization of one or more cationic ethylenically unsaturated monomers with an ethylenically unsaturated monomer having anhydride, imide, lactone, carboxylic acid, isocyanate or blocked isocyanate group and a reactive siloxane and processes for preparing them. These polymers are useful i.a. as a depositioning aid of hydrophobic actives onto fibrous substrates.

15 Claims, No Drawings

HYDROPHOBICALLY MODIFIED CATIONIC POLYMER

CROSS-REFERENCE TO RELATED APPLICATIONS

This application claims benefit (under 35 U.S.C. §119(e)) of U.S. Provisional Application 61/673,294, filed Jul. 19, 2012, which is incorporated by reference herein in its entirety.

BACKGROUND OF THE INVENTION

The present invention relates to hydrophobically modified cationic polymers obtainable by the polymerization of one or more cationic ethylenically unsaturated monomers with an ethylenically unsaturated monomer having an epoxy, anhydride, imide, lactone, carboxylic acid or isocyanate functionality and a reactive siloxane and processes for preparing them.

Detergent formulae which can provide both cleaning and fabric care benefits, e.g., fabric softening benefits, at the same time, are known, for example in the form of "2-in-1" compositions and/or "softening through the wash" compositions.

Due to the incompatibility of anionic surfactants and many cationic fabric care agents, e.g., quaternary ammonium fabric softening agents, in liquid detergent compositions, the detergent industry has formulated alternative compositions which utilize fabric care agents which are not necessarily cationic in nature. One such type of alternative fabric care agents comprises silicone, i.e., polysiloxane-based, materials. Silicone materials include nonfunctional types such as polydimethylsiloxane (PDMS) and functionalized silicones, and can be deposited onto fabrics during the wash cycle of the laundering process.

Care actives that drive these benefits need to be delivered to the fabric either through-the-wash or through-the-rinse added products. The challenge of delivering care actives onto substrates such as fabric through-the-wash involves two seemingly contradictory processes. The cleaning agents (surfactants) interact with care actives as if they were soil—emulsifying, solubilizing, and removing them from the wash systems. Deposition of benefit agents in the presence of cleaning agents is often exceedingly difficult without the use of deposition aid systems. Cationic deposition aids frequently form coacervating phases either in the fully formulated detergent composition and/or in the wash liquor wherein the detergent composition has been diluted with water. Thus, the deposition aid can also bring soils along with active agents to the fabric resulting in negative cleaning performance, inadequate deposition, unsatisfactory spreading performance, inadequate stability and other detrimental consequences. Hence, a deposition aid that is selective and at the same time enables a good cleaning of the fabric is needed.

WO 2006/061334 A1 reads on a surfactant cleaning composition for hard surfaces which contains a polymer comprising (I) a cationic monomer, (II) a hydrophobically unsaturated nonionic monomer, (Ill) optionally a water-soluble monomer. The cationic monomer is preferably diallyldimethyl ammonium chloride and the hydrophobic monomer an alkylacrylate. The water-soluble monomer can be a water-soluble aminosiloxane.

US 2009/0069522 A1 describes hydrophobically modified polyacrylamides containing acrylamide, anionic monomers and excluding cationic monomers for use in cosmetic applications as an alternative to fatty alcohol sulfates.

US 2007/0163054 A1 relates to a cationic silicone used for maintaining or rejuvenating a textile product's stain repellency. The aminosilicones are preferentially functionalized with linear or branched C1-C22 moieties or with alkylenes.

WO 2003/021037 A1 discloses a soft tissue product comprising a copolymer formed from one or more ethylenically unsaturated monomers and at least one unsaturated polysiloxane constituent.

A DETAILED DESCRIPTION OF THE INVENTION

It was thus an object of the present invention to provide polymers which enable an effective deposition of care actives such as silicones on the fabric while still showing a good cleaning efficiency of the fabric.

It has now been discovered that such challenges can be met by using cationic polymers hydrophobically modified with silicones.

The hydrophobically modified cationic polymers of the invention have shown outstanding deposition performance without negatives. The polymers behave at the same time like a polymeric dispersant which leads to the stabilization of hydrophobic material like silicone in aqueous media by adsorption on the interface of the hydrophobic material but also contributes to an improved depositioning of the hydrophobic material onto the fabric. The fabric thus treated shows an improved smooth feeling and better haptic effects.

It has also been found that the inventive polymer is suitable for application to fibrous substrates such as hair, leather and paper, to impart oil (oleophobicity) and water repellent properties (hydrophobicity) to the treated material.

The hydrophobically modified cationic polymer of the invention is obtainable by the polymerization of (a) one or more cationic ethylenically unsaturated monomers (compound A),
(b) an ethylenically unsaturated monomer having an epoxy, anhydride, imide, lactone, carboxylic acid or isocyanate functionality (compound B),
(c) optionally a water-soluble monomer (compound C),
(d) a reactive siloxane (compound D).

The hydrophobically modified cationic polymer, as defined above, comprises the following compounds:

Compound A

Compound A is a water-soluble cationic ethylenically unsaturated monomer.

Compound A can be a dialkyl diallyl ammonium with halides, hydrogensulfate or methosulfate as counterions according to formula (I), wherein:

$R_1$ and $R_2$ are, independently of one another, hydrogen or $C_1$-$C_4$ alkyl;

$R_3$ and $R_4$ are, independently of one another, hydrogen, alkyl, hydroxyalkyl, carboxyl alkyl, carboxyamide alkyl or alkoxyalkyl groups having from 1 to 18 carbon atoms; and Y— is the counterion selected from the group consisting of chloride, bromide, iodine or hydrogensulfate or methosulfate.

(I)

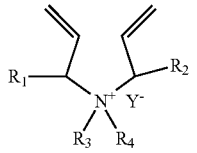

In another embodiment, compound A is a quaternary or acid salt of dialkyl amino alkyl(meth)acrylate.

In a further embodiment, compound A is an acid salt of a dialkyl amino alkyl(meth)acrylamide or a quaternary dialkyl amino alkyl(meth)acrylamide according to formula (II):

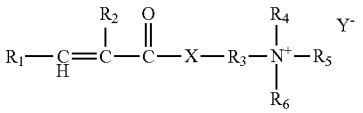

(II)

where $R_1$ is H or $C_1$-$C_4$-alkyl, $R_2$ is H or methyl, $R_3$ is $C_1$-$C_4$-alkylene, $R_4$, $R_5$ and $R_6$ are each independently H or $C_1$-$C_{30}$-alkyl, X is —O— or —NH— and Y is Cl; Br; I; hydrogensulfate or methosulfate.

In one embodiment of the present invention, it is preferred that, in the cationic monomer of the formula (II), i) $R_1$ and $R_2$ are each H or ii) $R_1$ is H and $R_2$ is $CH_3$ or preferably also H.

Suitable examples of compound A are diallyl dimethyl ammonium chloride (DADMAC), (3-acrylamidopropyl)-trimethylammonium chloride (APTAC), (3-methacryl-amidopropyl)-trimethylammonium chloride (MAPTAC), dimethylaminopropylacrylat methochloride, dimethylaminopropylmethacrylat methochloride.

Further suitable examples of compound A are [2-(Acryloyloxy)ethyl]trimethylammonium chloride also referred to as dimethylaminoethyl acrylate methochloride (DMA3*MeCl) or trimethyl-[2-(2-methylprop-2-enoyloxy)ethyl]azanium chloride also referred as dimethylaminoethyl methacrylate methochloride (DMAEMA*MeCl).

Compound A is preferably DADMAC.

Compound A can also be a quaternised N-vinylimidazole with a halide, a methosulfate or a hydrogensulfate as counterion.

Compound B

Compound B is an ethylenically unsaturated monomer having an epoxy, anhydride, imide, lactone, carboxylic acid, isocyanate functionality. Examples of olefinically unsaturated monomers having an anhydride functional group are maleic anhydride, glutaconic anhydride and itaconic anhydride. An example of an olefinically unsaturated monomers having an imide functional group is maleimide. Examples of olefinically unsaturated carboxylic acids are acrylic acid, methacrylic acid and maleic acid.

Preferably compound B is an epoxy-functional (meth) acrylic monomer of formula (III) such as glycidyl acrylate, glycidyl methacrylate, glycidyl carbonate acrylate, 3,4-epoxybutyl acrylate, 3,4-epoxybutyl methacrylate, vinylbenzyl glycidyl ether, allyl glycidyl ether or an ethylenically unsaturated monomer having an anhydride functionality such as maleic anhydride or glutaconic anhydride.

Formula (III)

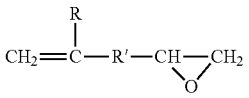

In formula (III), R is preferably hydrogen or alkyl of 1 to about 7 carbons and R' is an hydrocarbon moiety preferably alkyl or $COO(CH2)_n$ with n having a value of from 0 to 7.

Compound B is preferably glycidyl methacrylate (GMA).

Compound C

Compound C is hydrophilic. Usually, compound C has a solubility in water of at least 60 g/l at 20° C., preferably of at least 80 g/l and in particular at least 100 g/l. For example compound C may be dissolved in water at 20° C. in an amount of up to 200 g/L or more.

Suitable examples of compound C are N-vinylpyrrolidone, (meth)acrylamide, N-Vinyl formamide, vinyl acetate, vinyl imidazole, polyethylene glycol methyl ether methacrylate, poly (propylene glycol) methacrylate.

Compound D

Compound D is a reactive siloxane comprising Si—O moieties wherein said reactive siloxane is a polymer which may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one embodiment of the present invention, the reactive siloxane is a silicone aminoalcohol.

In another embodiment of the present invention, the reactive siloxane is an aminosilicone. The aminosilicone may comprise the structure of Formula I:

$$[R_1R_2R_3SiO_{1/2}]_{(j+2)}[(R_4Si(X—K)O_{2/2}]_k[R_4R_4SiO_{2/2}]_m[R_4SiO_{3/2}]_j \quad \text{Formula (I)}$$

wherein:

j is a number from 0 to about 98; in one aspect j is a number from 0 to about 48; in one aspect, j is 0;

k k is an integer from 0 to about 200, in one aspect k is an integer from 0 to about 50; when k=0, at least one of $R_1$, $R_2$ or $R_3$ is —X—K;

m is a number from 4 to about 5,000; in one aspect m is a number from about 10 to about 4,000; in another aspect m is a number from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—K; with the proviso that when k=0, at least one of $R_1$, $R_2$ or $R_3$ is —X—K; and each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy; and for each X—K, X comprises a divalent alkylene radical comprising 2-12 carbon atoms, in one aspect, each of said divalent alkylene radical is independently selected from the group consisting of —$(CH_2)_s$— wherein s is an integer from about 2 to about 8, in one aspect s is an integer from about 2 to about 4;

each K is selected independently from the group consisting of

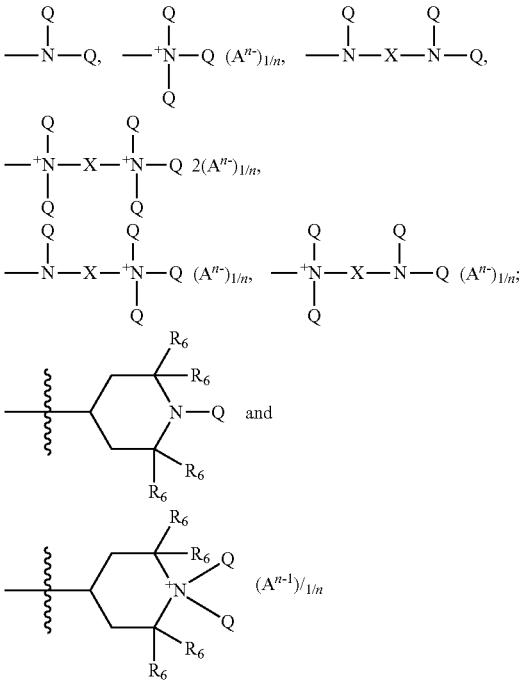

with the proviso that when K is quaternary, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H.

The aminosilicone has preferably a viscosity at 25° C. of from 50 $mm^2/s$ to 15000 $mm^2/s$, preferably, 500 $mm^2/s$ to 5000 $mm^2/s$, even more preferably 1000 $mm^2/s$ to 2500 $mm^2/s$.

In another embodiment of the present invention, the reactive siloxane is a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112.

Preferably compound D is an aminosilicone according to formula (I).

In a preferred embodiment, the hydrophobically modified cationic polymer of the invention is obtainable by the polymerization of (a) 5-98 wt % of compound A,
(b) 1-20 wt % of compound B,
(c) 0-85 wt % of compound C,
(d) 1-20 wt % of compound D.

In a further preferred embodiment, the hydrophobically modified cationic polymer of the invention is obtainable by the polymerization of:

(a) 10-85 wt % of compound A,
(b) 2-15 wt % of compound B,
(c) 5-80 wt % of compound C,
(d) 3-15 wt % of compound D.

In another preferred embodiment, the hydrophobically modified cationic polymer of the invention is obtainable by the polymerization of:

(a) 15-75 wt % of compound A,
(b) 3-10 wt % of compound B,
(c) 5-65 wt % of compound C,
(d) 3-10 wt % of compound D.

Polymerisation

The process for preparing the hydrophobically modified cationic polymer according to the invention comprises the following steps:

i) free-radical polymerization of compounds A, B and optionally C, ii) subsequent polymer-analogic reaction of the epoxy, anhydride, imide, lactone, carboxylic acid or isocyanate functionality of the polymer by compound D.

Step i)

The polymerization of step i) is a free-radical polymerization and is preferably carried out in solution, for example in water or in a polar organic solvent such as one or more alcohol, ketone or ester solvents selected from butanol, t-butanol, isopropanol, butoxyethanol, methyl isobutyl ketone, methyl ethyl ketone, butyl acetate or ethyl acetate and/or an aromatic hydrocarbon such as xylene, toluene or trimethylbenzene a blend of one or more of these. The solvent used for the solution polymerization is preferably water.

The solution polymerization preferably takes place at a temperature in the range from 50 to 140° C., preferably from 60 to 100° C., in particular from 70 to 95° C. The polymerization is usually carried out under atmospheric pressure, although it can also proceed under reduced or elevated pressure. A suitable pressure range is between 1 and 5 bar. The polymerization is carried out during a time of 2 and 5H, preferably 2H30 and 4H.

Compounds A, B and optionally C can be polymerized with the help of initiators which form free radicals, in the amounts customarily used, preferably from 0.1 to 5% by weight, even more preferably from 0.5 to 1% by weight, based on the total mass of the monomers to be polymerized.

Initiators for the free-radical polymerization which can be used are the peroxo and/or azo compounds customary for this purpose, for example alkali metal or ammonium peroxydisulfates, sodium persulfate, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumene hydroperoxide, diisopropyl peroxydicarbamate, bis(o-toloyl)peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, 2,2'-azobisisobutyronitrile, azobis(2-amidinopropane)dihydrochloride or 2-2'-azobis(2-methylbutyronitrile). Also suitable are initiator mixtures or redox initiator systems, such as, for example, ascorbic acid/iron(II) sulfate/sodium peroxodisulfate, tert-butyl hydroperoxide/sodium disulfite, tert-butyl hydroperoxide/sodium hydroxymethanesulfinate, $H_2O_2/Cu^I$.

The polymerization can be carried out continuously, semi-continuously or batch-wise. A plurality of monomers may be added separately or as mixtures, which can be produced, for example, by preparing a premix in a stirred vessel or by combining the individual feeds in a common pipeline. The initiator is usually added via a separate feed, but the monomer feed and initiator feed may be combined before entering the reaction vessel. Depending on the compatibility, the other components of the reaction mixture, e.g. polymerization regulators, are added together with one of the abovementioned feeds or separately, either in pure form or in a suitable solvent. In a suitable embodiment the polymerization can be carried out semi-continuously. According to this embodiment, at least one monomer can be initially introduced into a reactor and heated to the polymerization temperature, the monomer(s) and the free radical initiator being added either in one or more than one batches or preferably continuously to the reactor, and then be polymerized.

Where appropriate, after the main polymerization has taken place, a post-polymerization is performed to further polymerize the residual unreacted compounds A, B and optionally C.

In general, post-polymerization (chemical deodorization) denotes a process for removing at least a part of the residual monomers from a polymer composition by treating said composition under polymerization conditions with an initiator. In the postpolymerization, an initiator different from, similar to or the same as the initiator of the main polymerization is employed, for example a redox-initiator system. For the post-polymerization, the initiator is generally used in an amount from 0.01 to 1% by weight, in particular from 0.05 to 0.3% by weight, based on the total weight of the monomers initially employed. The temperature at which the post-polymerization of step ii) is carried out is within the range of from 10° C. to 200° C., in particular from 20° C. to 100° C. The post-polymerization generally takes place for a period of from about 1H to about 6H, more preferably from about 2H to about 4H. The initiator system can be added continuously or in portions essentially throughout the period of post-polymerization. Nevertheless, it is also possible to add a single dosage at the beginning of the post-polymerization. The adding of the initiator system depends inter alia on the temperature and the dissolution kinetics.

The post-polymerization may be performed under reduced pressure, at ambient pressure or at elevated pressure.

Step ii)

The polymeric product obtained from step i) has a functional group capable of reacting via ring opening or other condensation processes with the amino groups of the reactive siloxane. The functional group capable of reacting with the amino groups of the reactive siloxane can alternatively be an anhydride, imide, lactone, carboxylic acid or isocyanate.

Anhydride groups react with amino groups to form an amide linkage. Imide groups react with amino groups to form an amide linkage. Lactones react with amino groups to form an amidic ester linkage. Carboxylic acid groups react with amino groups, which can be tertiary, secondary or primary amino groups, at temperatures below about 100° C. to form an ionic salt linkage, and at temperatures above about 100° C. react with primary or secondary amine groups to form an amide linkage.

The reaction between the amino-functional polysiloxane (D) and the addition polymer is preferably carried out in solution, for example in a polar organic solvent as described for step i) or in water. The reaction can conveniently be carried out by adding the amino-functional polysiloxane (compound D) to the polymer solution obtained in step i). The reagents are usually heated to effect reaction. The preferred temperature of reaction depends on the nature of the functional group in monomer (B) which reacts with the amino groups of polysiloxane (D). When the functional group is an epoxide group, for example when monomer (B) is glycidyl methacrylate, the preferred temperature of reaction is generally in the range 60-120° C. In another embodiment of the invention, the polymer solution obtained after step i) may be cooled down and the reaction of step ii) may take place at room temperature, i.e. at around 20-25° C.

The amino-functional polysiloxane (D) and the polymer resulting from step i) can be reacted in various proportions. For example the amino groups of (D) may be present in stoichiometric excess over the functional groups derived from monomer (B), forming a polymeric product having residual unreacted amino groups. Such a polymeric product may be preferred for greater substantivity to fibrous substrates or softness of handle of the treated material. Alternatively the polysiloxane and the addition copolymer can be reacted in approximately stoichiometric amounts of amino groups of (D) and functional groups derived from monomer (B), or the functional groups derived from monomer (B) may be present in stoichiometric excess over the amino groups of compound D, forming a polymeric product bearing substantially no residual unreacted amino groups. Such a polymeric product may be preferred for maximum hydrophobicity.

A representation of the reaction process of the inventive hydrophobically modified cationic polymer is depicted on figure 1.

Compositions Comprising Inventive Polymer

The care actives to be deposited on surfaces such a textile, hair, leather, paper, can be perfume compositions and/or perfume raw materials, silicones, polyisobutene. The care actives are preferably hydrophobic.

The inventive polymer behaves like a polymeric dispersant which leads to the stabilization of hydrophobic material, i.e. the inventive polymers adsorbs on the interface of the hydrophobic material.

Suitable silicones comprise Si—O moieties and may be selected from (a) non-functionalized siloxane polymers, (b) functionalized siloxane polymers, and combinations thereof. The molecular weight of these organosilicones is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones may be linear, branched or cross-linked. In one aspect, the organosilicones may comprise silicone resins. Silicone resins are highly cross-linked polymeric siloxane systems. The cross-linking is introduced through the incorporation of trifunctional and tetrafunctional silanes with monofunctional or difunctional, or both, silanes during manufacture of the silicone resin.

Silicone materials and silicone resins in particular, can conveniently be identified according to a shorthand nomenclature system known to those of ordinary skill in the art as "MDTQ" nomenclature. Under this system, the silicone is described according to presence of various siloxane monomer units which make up the silicone. Briefly, the symbol M denotes the monofunctional unit $(CH_3)_3SiO_{0.5}$; D denotes the difunctional unit $(CH_3)_2SiO$; T denotes the trifunctional unit $(CH_3)SiO_{1.5}$; and Q denotes the quadra- or tetra-functional unit $SiO_2$. Primes of the unit symbols (e.g. M', D', T', and Q') denote substituents other than methyl, and must be specifically defined for each occurrence.

In one aspect, silicone resins for use in the compositions of the present invention include, but are not limited to MQ, MT, MTQ, MDT and MDTQ resins. In one aspect, Methyl is a highly suitable silicone substituent. In another aspect, silicone resins are typically MQ resins, wherein the M:Q ratio is typically from about 0.5:1.0 to about 1.5:1.0 and the average molecular weight of the silicone resin is typically from about 1000 to about 10,000.

Other modified silicones or silicone copolymers are also useful herein. Examples of these include silicone-based quaternary ammonium compounds (Kennan quats) disclosed in U.S. Pat. Nos. 6,607,717 and 6,482,969; end-terminal quaternary siloxanes; silicone amino-polyalkyleneoxide block copolymers disclosed in U.S. Pat. Nos. 5,807,956 and 5,981,681; hydrophilic silicone emulsions disclosed in U.S. Pat. No. 6,207,782; and polymers made up of one or more crosslinked rake or comb silicone copolymer segments disclosed in U.S. Pat. No. 7,465,439. Additional modified silicones or silicone copolymers useful herein are described in US Patent Application Nos. 2007/0286837A1 and 2005/0048549A1.

In alternative embodiments of the present invention, the above-noted silicone-based quaternary ammonium compounds may be combined with the silicone polymers described in U.S. Pat. Nos. 7,041,767 and 7,217,777 and US Application number 2007/0041929A1. In one aspect, the organosilicone may comprise a non-functionalized siloxane polymer that may have Formula (II) below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{Formula (II)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from 0 to about 10, or from 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the names DC 200 Fluid, DC 1664, DC 349, DC 346G available from Dow Corning® Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

Additional Additives to the Composition

Those of ordinary skill in the art will recognize that additional additives are optional but are often used in compositions of the type disclosed herein, for example fluid fabric enhancers. Thus such compositions may comprise an additional additive comprising: ingredients selected from the group comprising, additional softener actives, silicone compounds, structurants, deposition aids, perfumes, benefit agent delivery systems, dispersing agents, stabilizers, pH control agents, colorants, brighteners, dyes, odor control agent, solvents, soil release polymers, preservatives, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, shrinkage resistance agents, stretch resistance agents, thickeners, chelants, electrolytes and mixtures thereof. Such additives are known and can be included in the present formulation as needed. In one aspect, the fabric enhancer is free or substantially free of any of the aforementioned additives.

Suitable electrolytes for use in the present invention include alkali metal and alkaline earth metal salts such as those derived from potassium, sodium, calcium, magnesium.

Further Applications

The inventive polymer can also be useful in compositions for the treatment of substrates selected from hair, skin, nails, keratin containing substrate, hard surface, carpet, fabric, wood, plastic containing composition, and vinyl; and for treating household surface. The composition is selected from shampoos, aftershaves, sunscreens, lotions, hand and body creams, liquid soaps, bar soaps, bath oil bars, shaving creams, dishwashing liquids, detergents, surface cleaners, disposable wipes, conditioners, latex paints, permanent waves, hair relaxers, hair bleaches, hair detangling lotion, styling gel, styling glazes, spray foams, styling creams, styling waxes, styling lotions, mousses, spray gels, pomades, shower gels, bubble baths, hair coloring preparations, temporary and permanent hair colors, color conditioners, hair lighteners, coloring and non-coloring hair rinses, hair tints, hair wave sets, permanent waves, curling, hair straighteners, hair grooming aids, hair tonics, hair dressings and oxidative products, spritzes, styling waxes and balms (claimed). Also useful in dyeing of keratin fibers, particularly human hair; and for waving or straightening the hair.

TABLE 1

| siloxanes | | | | |
|---|---|---|---|---|
| Silicone N° | — | Silicone class | Technical information | Structure |
| X1 | — | amino silicone | Viscosity 25C = 1300 mm2/s<br>Functional group equivalent weight [g/mol] = 1700 | 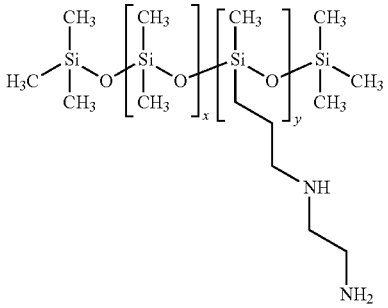 |
| X2 | — | | Viscosity 25C = 1500 mm2/s<br>Functional group equivalent weight [g/mol] = 3800<br>Mw = 30000 g/mol | |
| X3 | — | | Mw = 45000 g/mol<br>Functional group equivalent weight [g/mol] = 4300<br>X = approximately 500<br>Y = approximately 4 | |
| X4 | — | | X = approximately 444<br>Y = approximately 9 | |

TABLE 1-continued

| Silicone N° | — | Silicone class | Technical information | Structure |
|---|---|---|---|---|
| | | siloxanes | | |
| X5 | PDMS | polydimethyl siloxane | viscosity = 5000 cst | 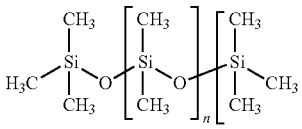 |
| X6<br>X7<br><br>X8 | —<br>—<br><br>— | Silicone polyether | hydroproxylated amino silicone X3<br>X7 = ½ Mw of X6<br>Viscosity = 2,600-2,850 cps<br>partially hydroproxylated silicone targeted 50% subsitution, NMR showing subsitution to be 50-67% of X1 | 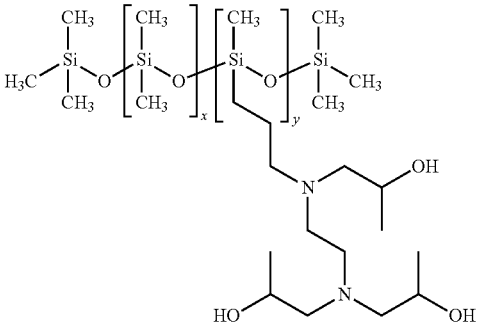 |

SYNTHESIS EXAMPLES OF DADMAC BASED POLYMERS

Example P1

In a 4 L stirred vessel, water (1148.8 g), diethylenetriaminepentaacetic acid, pentasodium (0.99 g), glycidylmethacrylate (5.19 g), vinylpyrrolidone (5.63 g), acrylamide in water (50%, 50.28 g), and diallyldimethylammonium chloride in water (65%, 96.86 g) were charged and heated to 80° C. under a flow of nitrogen. A solution of sodium persulfate (2.47 g) in water (98.9 g) is added over 4 h. Once the persulfate solution has been fed for 15 min, a solution of glycidylmethacrylate (34.78 g), vinylpyrrolidone (22.52 g), acrylamide in water (50%, 201.14 g), diallyldimethylammonium chloride in water (65%, 387.42 g) and water (357.37 g) are added together in one feed over 2 h and 45 min. The polymerization mixture is kept at this temperature for an additional 1 h after both streams have finished. Subsequently a solution of sodium persulfate (2.47 g) in water (98.83 g) is added over 1 h, the reaction kept at this temperature for 2 h and then left to cool down to room temperature. To the tetrapolymer solution the silicon polymer amino silicone—X4 (24.96 g) is added, stirred vigorously while heating to 80° C. and kept at this temperature for 1 h. The mixture is then cooled down to room temperature and filtered over a ED-Schnellsieb 400μ to yield the silicon functionalized product.

Example P2

In a 4 L stirred vessel, water (1128.92 g), diethylenetriaminepentaacetic acid, pentasodium (0.99 g), glycidylmethacrylate (7.97 g), acrylamide in water (50%, 127.45 g), and diallyldimethylammonium chloride in water (65%, 41.81 g) were charged and heated to 80° C. under a flow of nitrogen. A solution of sodium persulfate (2.47 g) in water (98.8 g) is added over 4 h. Once the persulfate solution has been fed for 15 min, a solution of glycidylmethacrylate (31.86 g), acrylamide in water (50%, 509.82 g), diallyldimethylammonium chloride in water (65%, 167.25 g) and water (279.78 g) are added together in one feed over 2 h and 45 min. The polymerization mixture is kept at this temperature for an additional 1 h after both streams have finished. Subsequently a solution of sodium persulfate (2.47 g) in water (98.83 g) is added over 1 h, the reaction kept at this temperature for 2 h and then left to cool down to room temperature. To the terpolymer solution the silicon polymer X4—(24.96 g) is added, stirred vigorously while heating to 80° C. and kept at this temperature for 1 h. The mixture is then cooled down to room temperature and filtered over a ED-Schnellsieb 400μ to yield the silicon functionalized product.

Example P3

In a 4 L stirred vessel, water (1152.77 g), diethylenetriaminepentaacetic acid, pentasodium (0.99 g), glycidylmethacrylate (4.12 g), acrylamide in water (50%, 15.05 g), and diallyldimethylammonium chloride in water (65%, 134.19 g) were charged and heated to 80° C. under a flow of nitrogen. A solution of sodium persulfate (2.47 g) in water (98.8 g) is added over 4 h. Once the persulfate solution has been fed for 15 min, a solution of glycidylmethacrylate (16.49 g), acrylamide in water (50%, 60.21 g), diallyldimethylammonium chloride in water (65%, 536.75 g) and water (375.28 g) are added together in one feed over 2 h and 45 min. The polymerization mixture is kept at this temperature for an additional 1 h after both streams have finished. Subsequently a solution of sodium persulfate (2.47 g) in water (98.83 g) is added over 1 h, the reaction kept at this temperature for 2 h and then left to cool down to room temperature. To the terpolymer solution the silicon polymer—X4(24.96 g) is added, stirred vigorously while heating to 80° C. and kept at this temperature for 1 h. The mixture is then cooled down to room temperature and filtered over a ED-Schnellsieb 400μ to yield the silicon functionalized product.

Example P4

In a 2 L stirred vessel, water (557.7 g), diethylenetriaminepentaacetic acid, pentasodium (0.48 g), glycidylmethacrylate (5.74 g), acrylamide in water (50%, 25.81 g), and diallyldimethylammonium chloride in water (65%, 45.16 g) were charged and heated to 80° C. under a flow of nitrogen. A solution of sodium persulfate (1.20 g) in water (48.0 g) is added over 4 h. Once the persulfate solution has been fed for 15 min, a solution of glycidylmethacrylate (22.94 g), acrylamide in water (50%, 103.26 g), diallyldimethylammonium chloride in water (65%, 180.66 g) and water (172.8 g) are added together in one feed over 2 h and 45 min. The polymerization mixture is kept at this temperature for an additional 1 h after both streams have finished. Subsequently a solution of sodium persulfate (1.20 g) in water (48.00 g) is added at once, the reaction kept at this temperature for 2 h and then left to cool down to room temperature. To the terpolymer solution the silicon polymer—X4 (24.96 g, in this case the polymer was split in three and only 7.8 g silicon added) is added, stirred vigorously while heating to 80° C. and kept at this temperature for 1 h. The mixture is then cooled down to room temperature and filtered over a ED-Schnellsieb 400μ to yield the silicon functionalized product.

Example P5

In a 2 L stirred vessel, water (998.02 g), diethylenetriaminepentaacetic acid, pentasodium (0.64 g) and glycidylmethacrylate (1.78 g), were charged and heated to 80° C. under a flow of nitrogen. A solution of sodium persulfate (1.58 g) in water (63.17 g) is added over 6 h. Once the persulfate solution has been fed for 15 min, glycidylmethacrylate (7.12 g), and diallyldimethylammonium chloride in water (65%, 443.71 g) are added in two independent feeds over 2 h and 45 min. The polymerization mixture is kept at this temperature for an additional 1 h after both streams have finished. Subsequently a solution of sodium persulfate (1.58 g) in water (63.17 g) is added at once, the reaction kept at this temperature for 2 h and then left to cool down to room temperature. To the copolymer solution the silicon polymer—X4 (24.96 g) is added, stirred vigorously while heating to 80° C. and kept at this temperature for 1 h. The mixture is then cooled down to room temperature and filtered over a ED-Schnellsieb 400μ to yield the silicon functionalized product.

Further Polymerization Examples

Polymers P6-P8 and P12 were prepared in a similar way as described in Example P1, taking the monomers, the type of amino-silicone and the respective amounts given in Table 2.

Polymers P9-P11 were prepared in a similar way as described in Example P2, taking the monomers, the type of amino-silicone and the respective amounts given in Table 2.

Polymers P13 was prepared in a similar way as described in Example P3, taking the monomers, the type of amino-silicone and the respective amounts given in Table 2.

TABLE 2

Table 2: Examples of inventive hydrophobically modified cationic polymers

| | Components | | | | | | GPC | |
|---|---|---|---|---|---|---|---|---|
| | wt % in Functionalized polymer | | | | | Silicone | | Mw |
| | AA | VP | DADMAC | GMA | Silicone | type | Mn (g/mol) | (g/mol) |
| P1 | 24.1 | 5.4 | 60.5 | 5.0 | 5.0 | X4 | 43600 | 194000 |
| P2-a | 59.7 | 0.0 | 25.5 | 7.4 | 7.4 | X4 | 80800 | 496000 |
| P2-b | 59.7 | 0.0 | 25.5 | 7.4 | 7.4 | X7 | 76100 | 424000 |
| P2-c | 59.7 | 0.0 | 25.5 | 7.4 | 7.4 | X8 | 75700 | 418000 |
| P3 | 7.3 | 0.0 | 84.7 | 4.0 | 4.0 | X4 | 33300 | 95300 |
| P4 | 24.0 | 0.0 | 54.6 | 10.7 | 10.7 | X4 | 41300 | 246000 |
| P5 | 0.0 | 0.0 | 81.8 | 9.1 | 9.1 | X4 | 26400 | 132000 |
| P6 | 63.4 | 18.1 | 9.1 | 4.7 | 4.7 | X4 | | |
| P7 | 62.3 | 6.7 | 18.6 | 6.2 | 6.2 | X4 | 73100 | 452000 |
| P8 | 30.9 | 7.8 | 51.6 | 4.9 | 4.9 | X4 | 50600 | 245000 |
| P9 | 35.0 | 0.0 | 55.5 | 4.8 | 4.8 | X4 | 41200 | 205000 |
| P10-a | 6.5 | 0.0 | 75.8 | 8.9 | 8.9 | X4 | 28200 | 143000 |
| P10-b | 6.5 | 0.0 | 75.8 | 8.9 | 8.9 | X7 | 28500 | 142000 |
| P10-c | 6.5 | 0.0 | 75.8 | 8.9 | 8.9 | X8 | 28500 | 142000 |
| P11 | 51.2 | 0.0 | 21.8 | 13.5 | 13.5 | X4 | | |
| P12 | 63 | 18.4 | 9.2 | 4.7 | 4.7 | X4 | | |
| P13-a | 7.4 | 0.0 | 90.6 | 1 | 1 | X1 | | |
| P13-b | 7.4 | 0.0 | 90.6 | 1 | 1 | X2 | 28400 | 68500 |
| P13-c | 7.4 | 0.0 | 90.6 | 1 | 1 | X4 | | |
| P13-d | 7.4 | 0.0 | 90.6 | 1 | 1 | X3 | | |

Analytical Characterization for Evidence of Particle Stabilization

Particle Size Characterization—PDMS (Polydimethylsiloxane) and Polymer System 3 g of PDMS or PDMS-polymer P3 mixture (2.7 g of silicone and 0.3 g of polymer) was mixed with 97 g detergent formulation using magnetic stirrer. The formula was 100 times diluted with deionized water and characterized by dynamic light scattering (Malvern HPPS Zetasizer at the scattering angle of 173°). The particle size is defined as the position of silicone peak in the particle size distribution.

| Active added into the formula | Particle size, micrometer |
|---|---|
| X5 | 64 |
| −X5 + P3 | 0.26 |

Polymer P3 Leads to Stabilization of PDMS: Direct Evidence of Polymer Adsorption on PDMS Interface Method of Use The compositions of the present invention may be used to treat fabric by administering a dose to a laundry washing machine or directly to fabric (e.g., spray). Such method comprises contacting the fabric with a composition described in the present specification. The compositions may be administered to a laundry washing machine during the rinse cycle or at the beginning of the wash cycle, typically during the rinse cycle. The fabric care compositions of the present invention may be used for handwashing as well as for soaking and/or pretreating fabrics. The composition may be in the form of a powder/granule, a bar, a pastille, foam, flakes, a liquid, a dispersible substrate, or as a coating on a dryer added fabric softener sheet. The composition may be administered to the washing machine as a unit dose or dispensed from a container (e.g., dispensing cap) containing multiple doses. An example of a unit dose is a composition encased in a water soluble polyvinylalcohol film.

In one aspect, a method of treating and/or cleaning a situs, said method comprising a) optionally washing and/or rinsing said situs;

b) contacting said situs with a liquid fabric enhancer composition disclosed herein; and c) optionally washing and/or rinsing said situs.

d) optionally drying said situs via and automatic dryer and/or line drying is disclosed.

Test Methods

EXAMPLES

Example 1

Particle Made in the Presence of Non-Ionic Emulsifiers (2 Different HLB's)

Preparation of a H2O/Si emulsion, using low HLB surfactant/emulsifier then invert during dilution to form Si/H2O emulsion.

| RM | Examples | Level (wt % of total composition) |
|---|---|---|
| Silicone fluid | Amino Silicone or PDMS | 40% |
| Emulsifier #1 | Tergitol 15-s-5 | 1.25 |
| Polymer | polymer | 1.8% |
| Emulsifier #2 | Tergitol 15-s-12 | 1.93 |
| Water | Distilled | To 100% |
| Acetic Acid | glacial | to pH 5 |

Using IKA T25 Ultra-Turrax disperser (300 W Output) and IKA Dispersing element (S25N-25G), in a non-plastic container, add silicone fluid and polymer. Mix for 5 minutes at 500 RPM. Add Emulsifier #1, mix for 5 min at 500 RP. In a separate container, blend Emulsifier #2 and water, mix until completely dispersed. Add water+emulsifier #2 composition to Silicone/polymer/emulsifier #1 composition, in 3 equal aliquots. After addition of each aliquot, mix at 3,000 RPM until homogeneous and uniform consistency. After all of the water+emulsifier #2 is combined, add glacial acetic acid to adjust pH, mix for 20 minutes at 3,000 RPM.

Example 2

Non-Ionic Emulsifier (1 Non-Ionic Surfactant/Emulsifier)

Preparation Via Single Emulsifier Preparation Method

| RM | Examples | Level (wt % of total composition) |
|---|---|---|
| Water | Distilled | To 100% |
| Emulsifier #1 | Lutensol XP70 (BASF) | 5% |
| Silicone fluid | Amino Silicone or PDMS | 40% |
| Polymer | polymer | 4% |
| Acetic Acid | glacial | to pH 5 |

Using IKA T25 Ultra-Turrax disperser (300 W Output) and IKA Dispersing element (S25N-25G), in a non-plastic container, blend Emulsifier #1 and water, mix until completely dispersed. In a separate non-plastic container, fluid and polymer. Mix for 5 minutes at 500 RPM. Add Silicone polymer composition to the water/emulsifier #1 composition at approximately 10 gram/min, with constant mixing at 3,000 RPM. Mix entire composition for 20 minutes at 3,000 RPM. Add glacial acetic acid to adjust pH, mix for 3 minutes at 3,000 RPM.

Example 3

Polymer Emulsifier (No Added Surfactant/Emulsifier)

Preparation Via Single Emulsifier Using Polymer Emulsifier Preparation Method

| RM | Examples | Level (wt % of total composition) |
|---|---|---|
| Polymer | polymer | 2.25% |
| Water | Distilled | To 100% |
| Silicone fluid | Amino Silicone or PDMS | 40% |
| Acetic Acid | glacial | to pH 5 |

Follow preparation method in Example #2 except add polymer to water and no addition to silicone fluid.

Example 4

Polymer Emulsifier (No Added Surfactant/Emulsifier)

Preparation via single emulsifier using polymer emulsifier preparation method. The materials and level are the same as in Example 2 except polymer is added to the silicone and 5% of the total water is added to the silicone+polymer composition.

| RM | Examples | Level (wt % of total composition) |
|---|---|---|
| Silicone fluid | Amino Silicone or PDMS | 40% |
| Polymer | polymer | 2.25% |
| Water | Distilled | 5% of total emulsion volume |
| Water | Distilled | To 100% |
| Acetic Acid | glacial | to pH 5 |

Example 5

In-Situ: In Product Particle Formation (No Added Surfactant/Emulsifier)

Preparation Via Single Emulsifier Preparation Method

| RM | Examples | Level (wt % of total composition) |
|---|---|---|
| Silicone fluid | Amino Silicone or PDMS | 99% |
| Polymer | polymer | 1% |

Using a IKA-RW20 overhead mixer with a 90 degree flat blade impeller, in a non-plastic container, blend polymer and silicone for 20 minutes @ 500 RPM until uniformly dispersed.

Example 6

Heavy Duty Liquid Detergents

The following heaving duty liquid detergents are made by mixing the ingredients listed below via conventional processes. Such heavy duty liquid detergents are used to launder fabrics that are then dried by line drying and/or machine drying. Such fabrics may be treated with a fabric enhancer prior to and/or during drying. Such fabrics exhibit a clean appearance and have a soft feel.

| Ingredient | Example 1 Wt % | Example 2 Wt % | Example 3 Wt % | Example 4 Wt % | Example 5 Wt % | Example 6 Wt % |
|---|---|---|---|---|---|---|
| C12-15 alkyl polyethoxylate (1.8) sulfate[1] | 16.0 | 16.0 | 14.6 | 8.0 | 20.1 | 7.3 |
| C12 alkyl trimethyl ammonium chloride[2] | — | — | — | — | 2.0 | — |
| C16/C17 Sodium Alkylsulfonate (HSAS)[3] | 1.9 | 1.9 | 1.7 | — | — | 0.85 |
| Sodium alkylbenzenesulfonate[3] | 4.5 | 4.9 | 4.4 | 3.5 | — | 2.0 |
| 1,2 Propane diol/di-ethylene glycol | 4.7 | 4.8 | 4.4 | 2.6 | 4.9 | 2.7 |
| Ethanol | 1.9 | 1.9 | 1.9 | 1.1 | 2.7 | 0.9 |
| Neodol 23-9[9] | 0.7 | 0.7 | 0.7 | 0.3 | 0.8 | 0.4 |
| $C_{12-18}$ Fatty Acid[4] | 1.6 | 1.6 | 1.4 | 0.5 | 1.0 | 0.7 |
| Citric acid | 3.6 | 3.6 | 3.3 | 1.5 | 3.4 | 1.6 |
| Enzymes, (Protease[5], amylase[5]) | 1.8 | 1.8 | 1.6 | 0.6 | 0.35 | 0.8 |
| Fluorescent Whitening Agent[6] | 0.21 | 0.19 | 0.19 | 0.07 | 0.08 | 0.13 |
| DTPA | 0.35 | 0.32 | 0.32 | 0.4 | 0.5 | 0.2 |
| Ethoxylated polyamine[7] | 2.5 | 1.6 | 1.6 | 1.5 | 0.6 | 0.75 |
| Hydrogenated castor oil | — | 0.12 | 0.12 | 0.6 | 0.12 | 0.1 |
| Ethoxylated hexamethylane diamine[8] | 1.5 | — | — | — | — | — |
| Particle according to present invention comprising Silicone[9] and TDA[10] in ratio of (20:1) | 1.56 | 2.6 | 5.25 | 5.25 | 4.2 | 5.25 |
| Water and adjuncts[11] | | | Balance to 100% | | | |

[1]Available from Shell Chemicals, Houston, TX

[2]Available from Degussa Corporation, Hopewell, VA.

[3]Available from Shell Chemicals, Houston, TX.

[4]Available from The Procter & Gamble Company, Cincinnati, OH.

[5]Available from Genencor International, South San Francisco, CA.

[6]Available from Ciba Specialty Chemicals, High Point, NC.

[7]Sold under the tradename LUTENSIT ®, available from BASF (Ludwigshafen, Germany) and described in WO 01/05874.

[8]Available from Nippon Shokkabai

[9]Aminofunctional silicones,; KF869, KF867 Shin-Etsu Silicones, Akron OH; CF42-xxx from Momentive Silicones, Akron, OH, USA; a polydimethyl siloxane of viscosity 5000, 10000 Cst available from Gilest, Morrisville, PA, USA and 60,000 centistroke available from Dow Corning Corporation, Midland, MI.

[10]TDA silicone pendent cationic acrylamide, silicone modified polyethyleneimine, supplied by BASF, 67056 Ludwigshafen, Germany or blacklined

[11]May include, but not limited to: stabilizers, perfumes, dyes, rheology modifiers, opacifier, cleaning polymers Example 7

Fabric Enhancers

The following are non-limiting examples of the compositions of the present invention such compositions are made by one or more of the processes of making disclosed in the present specification.

| (% wt) | I | II | III | IV | V |
|---|---|---|---|---|---|
| FSA[a] | 12 | 21 | 18 | 14 | 12 |
| FSA[b] | — | — | — | — | — |
| FSA[c] | — | — | — | — | — |
| Low MW alcohol | 1.95 | 3.0 | 3.0 | 2.28 | 2.28 |
| Rheology modifier[d,e,] | 1.25[d] | — | 0.2[e] | — | 0.2[e] |
| Perfume | 1.50 | 2.3 | 2.0 | 1.50 | 1.50 |
| Perfume encapsulation | 0.6 | 0.3 | 0.4 | — | 0.15 |
| Phase Stabilizing Polymer[f] | 0.25 | — | — | 0.142 | 0.25 |
| Suds Suppressor[g] | — | — | — | — | — |
| Calcium Chloride | 0.10 | 0.12 | 0.1 | 0.45 | 0.55 |
| DTPA[h] | 0.005 | 0.005 | 0.005 | 0.005 | 0.005 |
| Preservative (ppm)i | 5 | 5 | 5 | 5 | 5 |
| Antifoam[j] | 0.015 | 0.15 | 0.11 | 0.011 | 0.011 |
| Polyethylene imines[l] | 0.15 | 0.05 | — | 0.1 | — |

-continued

| | | | | | |
|---|---|---|---|---|---|
| Particle according to present invention comprising Silicone[m] and TDA[n] in ratio of (20:1) | 1.56 | 2.6 | 5.25 | 5.25 | 4.2 |
| Stabilizing Surfactant [o] | — | — | 0.5 | 0.2 | 0.2 |
| Organosiloxane polymer[p] | 5 | — | — | — | — |
| Amino-functional silicone | — | — | — | — | 5 |
| Dye (ppm) | 40 | 11 | 30 | 40 | 40 |
| Ammonium Chloride | 0.10 | 0.12 | 0.12 | 0.10 | 0.10 |
| HCl | 0.010 | 0.01 | 0.10 | 0.010 | 0.010 |
| Deionized Water | Balance | Balance | Balance | Balance | Balance |

| (% wt) | VI | VII | VIII | IX | X | XI | XII |
|---|---|---|---|---|---|---|---|
| FSA[a] | 16 | 12 | 5 | 5 | — | — | — |
| FSA[b] | — | — | — | — | 3.00 | — | — |
| FSA[c] | — | — | — | — | — | 7 | — |
| FSA[z] | — | — | — | — | — | — | 12 |
| Low MW alcohol | 1.50 | 2.68 | 0.81 | 0.81 | 0.3 | 0.9 | — |
| Rheology modifier[d,e,] | — | — | 0.42[d] | 0.25[e] | 0.5[d] | 0.70[d] | — |
| Perfume | 2.20 | 1.50 | 0.60 | 0.60 | 1.30 | 0.8-1.5 | 2.4 |
| Perfume encapsulation | 0.4 | 0.25 | — | 0.3 | 0.1 | — | — |
| Phase Stabilizing Polymer[f] | — | 0.25 | — | — | — | — | — |
| Suds Suppressor[g] | — | — | 0.1 | — | — | 0.1 | — |
| Calcium Chloride | 0.350 | 0.545 | — | — | — | 0.1-0.15 | 0.05 |
| DTPA[h] | 0.005 | 0.007 | 0.002 | 0.002 | 0.20 | — | 0.05 |
| Preservative (ppm)i | 5 | 5 | 5 | 5 | — | 250 | 75 |
| Antifoam[j] | 0.011 | 0.011 | 0.015 | 0.015 | — | — | 0.005 |
| Polyethylene imines[l] | — | 0.1 | — | 0.05 | — | — | — |
| Particle according to present invention comprising Silicone[m] and TDA[n] in ratio of (20:1) | 1.56 | 2.6 | 5.25 | 5.25 | 4.2 | 4.2 | 1.56 |
| PDMS emulsion[n] | — | — | 0.25 | — | — | — | — |
| Stabilizing Surfactant [o] | 0.1 | 0.2 | — | — | — | — | — |
| Organosiloxane polymer[p] | 2 | — | — | — | — | 0-5.0 | 3.0 |
| Amino-functional silicone | — | 2 | — | — | — | 0-5.0 | — |
| Dye (ppm) | 40 | 40 | 30 | 30 | 11 | 30-300 | 30-300 |
| Ammonium Chloride | 0.10 | 0.115 | — | — | — | — | — |
| HCl | 0.010 | 0.010 | 0.011 | 0.011 | 0.016 | 0.025 | 0.01 |
| Deionized Water | Balance | Balance | Balance | Balance | Balance | Balance | Balance |

[a]N,N-di(tallowoyloxyethyl)-N,N-dimethylammonium chloride.

[b]Methyl bis(tallow amidoethyl)2-hydroxyethyl ammonium methyl sulfate.

[c]Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[z]The Reaction product of fatty acid with an iodine value of 40 with methyl/diisopropylamine in a molar ratio from about 1.86 to 2.1 fatty acid to amine and quaternized with methyl sulfate.

[d]Cationic high amylose maize starch available from National Starch under the trade name HYLON VII ®.

[e]Cationic polymer available from Ciba under the name Rheovis CDE.

[f]Copolymer of ethylene oxide and terephthalate having the formula described in U.S. Pat. No. 5,574,179 at col.15, lines 1-5, wherein each X is methyl, each n is 40, u is 4, each R1 is essentially 1,4-phenylene moieties, each R2 is essentially ethylene, 1,2-propylene moieties, or mixtures there-of.

[g]SE39 from Wacker.

[h]Diethylenetriaminepentaacetic acid.

[i]Koralone B-119 available from Rohm and Haas Co. "PPM" is "parts per million."

[j]Silicone antifoam agent available from Dow Corning Corp. under the trade name DC2310.

[l]Polyethylene imines available from BASF under the trade name Lupasol.

[m]Aminofunctional silicones.; KF869, KF867 Shin-Etsu Silicones, Akron OH; CF42-xxx from Momentive Silicones, Akron, OH, USA; a polydimethyl siloxane of viscosity 5000, 10000 Cst available from Gilest, Morrisville, PA, USA and 60,000 centistroke available from Dow Corning Corporation, Midland, MI.

[n]TDA silicone pendent cationic acrylamide, silicone modified polyethyleneimine, supplied by BASF, 67056 Ludwigshafen, Germany, or blacklined

[p]Organosiloxane polymer condensate made by reacting hexamethylenediisocyanate (HDI), and a,w silicone diol and 1,3-propanediamine, N'-(3-(dimethylamino)propyl)-N,N-dimethyl-Jeffcat Z130) or N-(3-dimethylaminopropyl)-N,Ndi-isopropanolamine (Jeffcat ZR50) commercially available from Wacker Silicones, Munich, Germany.

Example 8

Use of Fabric Enhancers

The fluid fabric enhancer active formulations in Examples I-XII are used to soften fabrics. The formulations are used in a laundry rinse of an automatic laundry washing machine. Upon completion of the rinse, the fabrics are either machine dried or line dried.

Example 9

Unit Dose

Each of the fluid fabric enhancer active formulations of Examples I-XII are also placed in a unit dose packaging comprising a film that surrounds each formulations./ Such unit does are used by adding the unit dose to the wash liquor and/or the rinse. Upon completion of the rinse, the fabrics are either machine dried or line dried.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A hydrophobically modified cationic polymer obtained by the polymerization of (A) one or more cationic ethylenically unsaturated monomers, wherein (A) is diallyl dimethyl ammonium chloride and/or quaternized vinylimidazole, (B) an ethylenically unsaturated monomer having an epoxy, anhydride, imide, lactone, carboxylic acid or isocyanate functionality, (C) optionally a water-soluble monomer, and (D) a reactive siloxane, wherein the polymerization comprises:

i) free-radical polymerizing (A), (B) and optionally (C) to obtain a polymer, and ii) subsequently polymer-analogous reacting the epoxy, anhydride, imide, lactone, carboxylic acid or isocyanate functionality of the polymer with (D).

2. A hydrophobically modified cationic polymer obtained by the polymerization of (A) one or more cationic ethylenically unsaturated monomers, (B) an ethylenically unsaturated monomer selected from the group consisting of glycidyl (meth)acrylate, 3,4-epoxybutyl acrylate, 3,4-epoxybutyl methacrylate, vinylbenzyl glycidyl ether, allyl glycidyl ether, glycidyl carbamate acrylate, maleic anhydride, glutaconic anhydride and a mixture thereof, (C) optionally a water-soluble monomer, and (D) a reactive siloxane, wherein the polymerization comprises:

i) free-radical polymerizing (A), (B) and optionally (C) to obtain a polymer, and ii) subsequently polymer-analogous reacting the epoxy, anhydride, imide, lactone, carboxylic acid or isocyanate functionality of the polymer with (D).

3. The hydrophobically modified cationic polymer according to claim 1 wherein (C) is selected from the group consisting of vinylpyrrolidone, (meth)acrylamide, N-Vinyl formamide, vinyl acetate, vinyl imidazole, polyethylene glycol methyl ether methacrylate, poly (propylene glycol) methacrylate and a mixture thereof.

4. The hydrophobically modified cationic polymer according to claim 1, wherein (D) is an aminosilicone, a silicone aminoalcohol or a silicone polyether or a mixture thereof.

5. The hydrophobically modified cationic polymer according to claim 4, wherein (D) is an aminosilicone.

6. The hydrophobically modified cationic polymer according to claim 1 obtained by the polymerization of (a) 5-98 wt % of (A), (b) 1-20 wt % of (B), (c) 0-85 wt % of (C), and (d) 1-20 wt % of (D).

7. The hydrophobically modified cationic polymer according to claim 1 obtained by the polymerization of (a) 10-85 wt % of (A), (b) 2-15 wt % of (B), (c) 5-85 wt % of (C), and (d) 3-15 wt % of (D).

8. The hydrophobically modified cationic polymer according to claim 1, wherein the polymer has a weight average molecular weight in the range of from 90000 g/mol to 700000 g/mol.

9. The hydrophobically modified cationic polymer according to claim 2, wherein (B) is glycidyl methacrylate and/or glycidyl carbonate acrylate.

10. The hydrophobically modified cationic polymer according to claim 2, wherein (C) is selected from the group consisting of vinylpyrrolidone, (meth)acrylamide, N-Vinyl fonnamide, vinyl acetate, vinyl imidazole, polyethylene glycol methyl ether methacrylate, poly (propylene glycol) methacrylate and a mixture thereof.

11. The hydrophobically modified cationic polymer according to claim 2, wherein (D) is an aminosilicone, a silicone aminoalcohol or a silicone polyether or a mixture thereof.

12. The hydrophobically modified cationic polymer according to claim 11, wherein (D) is an aminosilicone.

13. The hydrophobically modified cationic polymer according to claim 2 obtained by the polymerization of (a) 5-98 wt % of (A), (b) 1-20 wt % of (B), (c) 0-85 wt % of (C), and (d) 1-20 wt % of (D).

14. The hydrophobically modified cationic polymer according to claim 2 obtained by the polymerization of (a) 10-85 wt % of (A), (b) 2-15 wt % of (B), (c) 5-85 wt % of (C), and (d) 3-15 wt % of (D).

15. The hydrophobically modified cationic polymer according to claim 2, wherein the polymer has a weight average molecular weight in the range of from 90000 g/mol to 700000 g/mol.

* * * * *